US010048717B1

(12) United States Patent
Chen

(10) Patent No.: US 10,048,717 B1
(45) Date of Patent: Aug. 14, 2018

(54) VOLTAGE REGULATION DEVICE CAPABLE OF STABILIZING OUTPUT VOLTAGE

(71) Applicant: Powerchip Technology Corporation, Hsinchu (TW)

(72) Inventor: Kuan-Min Chen, Hsinchu (TW)

(73) Assignee: Powerchip Technology Corporation, Hsinchu (TW)

( * ) Notice: Subject to any disclaimer, the term of this patent is extended or adjusted under 35 U.S.C. 154(b) by 0 days.

(21) Appl. No.: 15/835,432

(22) Filed: Dec. 7, 2017

(30) Foreign Application Priority Data

Aug. 17, 2017 (TW) ..... 106127897 A

(51) Int. Cl.
*G05F 3/26* (2006.01)

(52) U.S. Cl.
CPC ..... *G05F 3/262* (2013.01)

(58) Field of Classification Search
CPC ..... G05F 3/262
See application file for complete search history.

(56) References Cited

U.S. PATENT DOCUMENTS 6,507,246 B1 * 1/2003 Brokaw ..... H03F 3/3037 330/285
6,573,694 B2 6/2003 Pulkin
7,486,572 B2 2/2009 Luo
8,810,219 B2 8/2014 Suzuki
8,884,604 B2 * 11/2014 Zolnhofer ..... G05F 3/262 323/280
2001/0052818 A1 * 12/2001 Suzuki ..... H03F 3/3027 330/253
2013/0069607 A1 3/2013 Suzuki
2014/0184184 A1 7/2014 Yajima
2015/0185747 A1 * 7/2015 Liu ..... G05F 1/565 323/268
2017/0373654 A1 * 12/2017 Pasotti ..... H03F 3/45273

FOREIGN PATENT DOCUMENTS

| | | | |
|---|---|---|---|
| EP | 2894537 | A1 | 7/2015 |
| JP | WO2013/042285 | A1 | 3/2013 |
| TW | 201327084 | A1 | 7/2013 |
| WO | 02/084426 | A2 | 10/2002 |
| WO | 2013/109681 | A2 | 7/2013 |
| WO | 2014/038284 | A1 | 3/2014 |

* cited by examiner

*Primary Examiner* — Adolf Berhane
*Assistant Examiner* — Bart Iliya
(74) *Attorney, Agent, or Firm* — Winston Hsu

(57) ABSTRACT

A voltage regulation device includes a first transistor, a first bias current source, a bias resistor, a second transistor, a second bias current source, and a detection adjustment circuit. The first transistor is coupled to the first bias current source for outputting a reference voltage. The bias resistor is coupled to the first transistor for receiving a regulation current. The second transistor has a first terminal for receiving a system voltage, a second terminal for outputting an output voltage, and a control terminal for receiving the reference voltage. The second bias current source is coupled to the second terminal of the second transistor. The detection adjustment circuit is coupled to the first transistor and the second transistor. When the output voltage is too low, the detection adjustment circuit activates the compensation current source to increase the voltage at the control terminal of the second transistor.

10 Claims, 5 Drawing Sheets

VOLTAGE REGULATION DEVICE CAPABLE OF STABILIZING OUTPUT VOLTAGE

BACKGROUND OF THE INVENTION

1. Field of the Invention

This invention is related to a voltage regulation device, and more particularly, to a voltage regulation device capable of stabilizing the output voltage instantly when the loading current increases suddenly.

2. Description of the Prior Art

FIG. 1 shows a voltage regulation device 100 of prior art. In FIG. 1, the voltage regulation device 100 includes a transistor M0 and a bias current source CS. The control terminal of the transistor M0 receives a reference voltage $V_C$ predefined by the system, and the second terminal of the transistor M0 is coupled to the bias current source CS. With the properly selected reference voltage $V_C$ and the bias current source CS, the voltage $V_{OUT}$ at the second terminal of the transistor M0 can be maintained at a desired voltage level.

In FIG. 1, the voltage $V_{OUT}$ generated by the voltage regulation device 100 can be outputted to the load circuit LD as power supply. FIG. 2 shows the waveforms of current and voltage of the voltage regulation device 100. In FIG. 2, when the load current $I_{LD}$ consumed by the load circuit LD increases, the transistor M0 would generate a greater current. Since the reference voltage $V_C$ is a constant value, the voltage at the second terminal of the transistor M0, that is, the output voltage $V_{OUT}$ generated by the voltage regulation device 100 would be pulled down. If the current consumed by the load circuit LD is rather big, then the output voltage $V_{OUT}$ would be pulled down to a rather low level, making the load circuit LD unable to perform normal operations, causing the instability of the load circuit.

SUMMARY OF THE INVENTION

One embodiment of the present invention discloses a voltage regulation device. The voltage regulation device includes a first bias current source, a first transistor, a bias resistor, a second transistor, a second bias current source, and a detection adjustment circuit.

The first bias current source generates a first bias current. The first transistor has a first terminal configured to receive the first bias current, a second terminal, and a control terminal coupled to the first terminal of the first transistor. The bias resistor has a first terminal coupled to the second terminal of the first transistor and configured to receive a regulation current, and a second terminal configured to receive a first voltage. The second transistor has a first terminal configured to receive a second voltage, a second terminal configured to output an output voltage, and a control terminal coupled to the first terminal of the first transistor. The second bias current source is coupled to the second terminal of the second transistor and for generating a second bias current.

The detection adjustment circuit includes a compensation current source, a third transistor, a fourth transistor, and a third bias current source. The compensation current source is coupled to the control terminal of the second transistor. The third transistor has a first terminal coupled to the compensation current source, a second terminal, and a control terminal coupled to the second terminal of the first transistor. The fourth transistor has a first terminal configured to receive the second voltage, a second terminal coupled to the second terminal of the third transistor, and a control terminal coupled to the second terminal of the second transistor. The third bias current source is coupled to the second terminal of the fourth transistor and configured to generate a third bias current.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
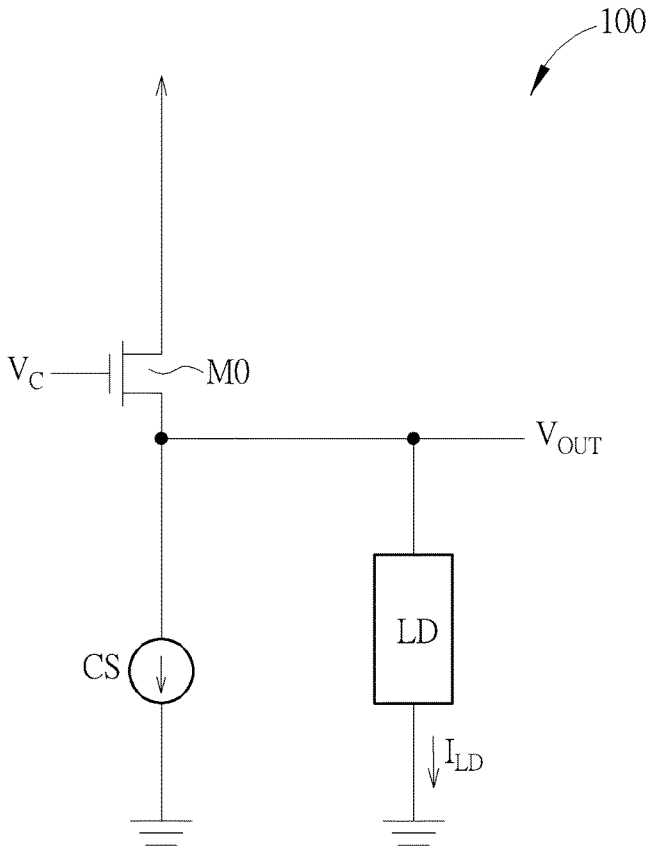
FIG. 1 PRIOR ART
FIG. 1 shows a voltage regulation device of prior art.
Figure 2:
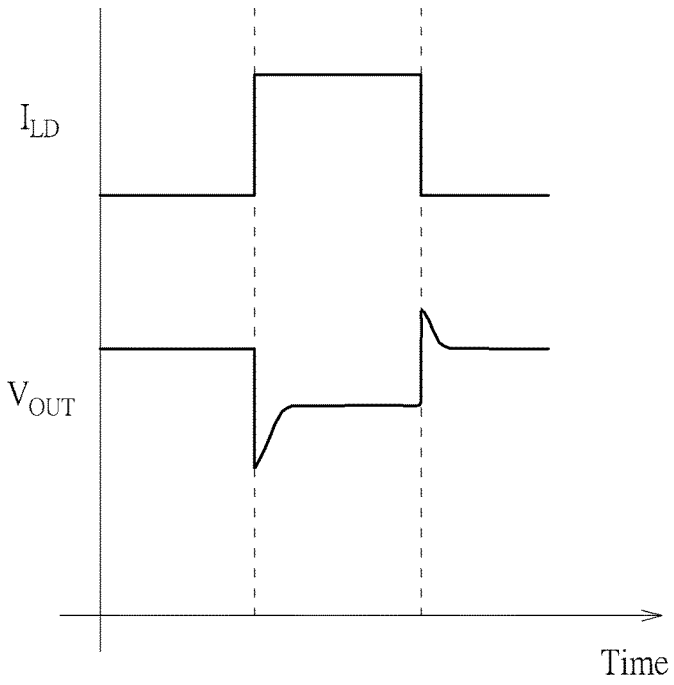
FIG. 2 PRIOR ART
FIG. 2 shows the waveforms of current and voltage of the voltage regulation device in FIG. 1.
Figure 3:
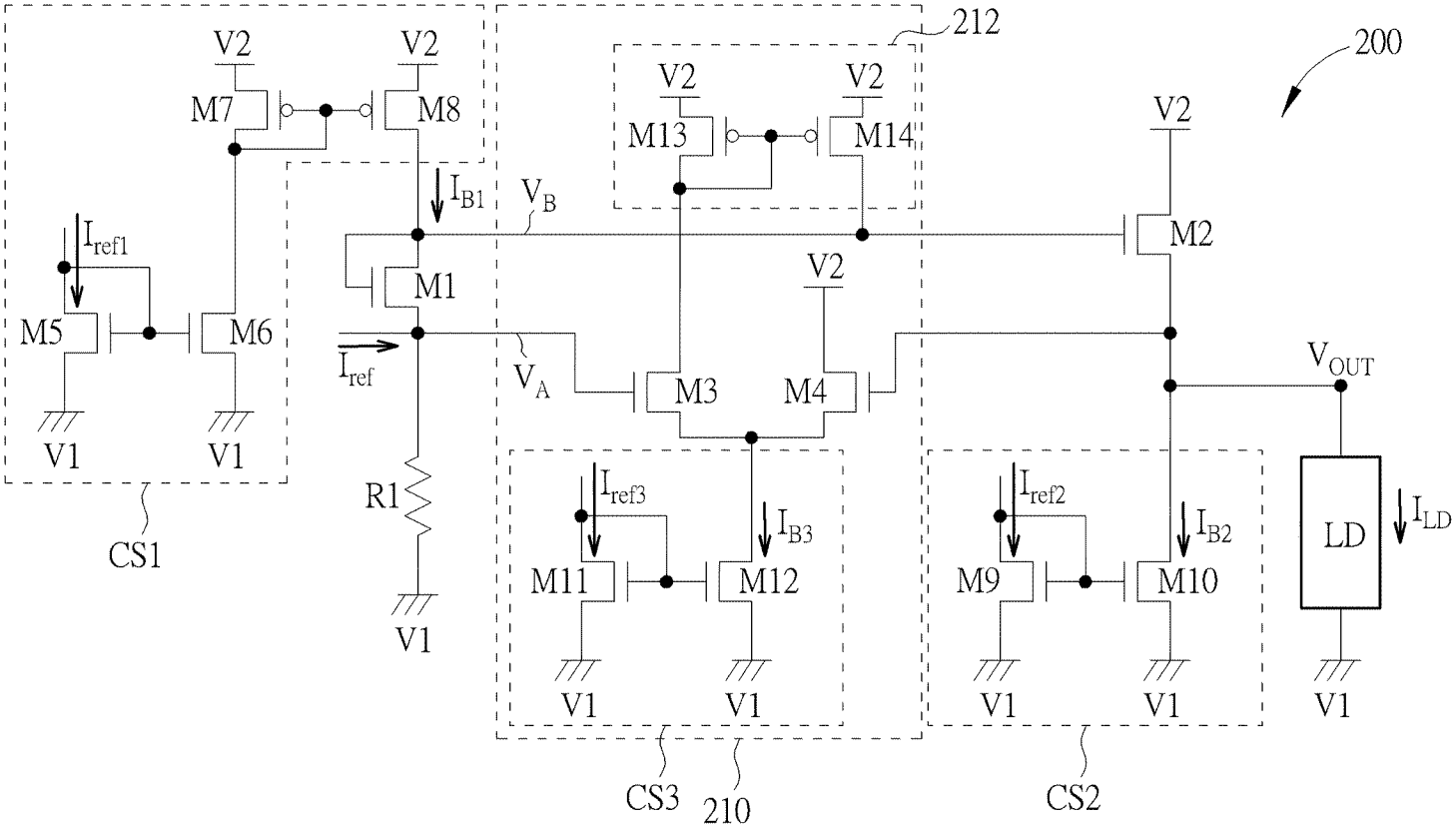
FIG. 3 shows a voltage regulation device according to one embodiment of the present invention.

FIG. 3 shows a voltage regulation device 200 according to one embodiment of the present invention. The voltage regulation device 200 includes a first bias current source CS1, a first transistor M1, a bias resistor R1, a second transistor M2, a second bias current source CS2, and a detection adjustment circuit 210.

The first bias current source CS1 can generate a first bias current $I_{B1}$. The first transistor M1 has a first terminal, a second terminal, and a control terminal. The first terminal of the first transistor M1 can receive the first bias current $I_{B1}$, and the control terminal of the first transistor M1 is coupled to the first terminal of the first transistor M1. The bias resistor R1 has a first terminal and a second terminal. The first terminal of the bias resistor R1 is coupled to the second terminal of the first transistor M1 and can receive the regulation current $I_{ref}$, and the second terminal of the bias resistor R1 can receive the first voltage V1.

In some embodiments of the present invention, the regulation current $I_{ref}$ is much greater than the first bias current $I_{B1}$ so the voltage at the first terminal of the bias resistor R1, that is, the first reference voltage $V_A$, can be mainly controlled by the regulation current $I_{ref}$ and can be maintained at a fixed value. In addition, by providing the first bias current $I_{B1}$ properly, the voltage at the first terminal of the first transistor M1, that is, the second reference voltage $V_B$, can be adjusted to a predetermined value required by the system, and can be used as a reference voltage controlling the second transistor M2.

The second transistor M2 has a first terminal, a second terminal, and a control terminal. The first terminal of the second transistor M2 can receive the second voltage V2, the second terminal of the second transistor M2 can output the output voltage $V_{OUT}$, and the control terminal of the second transistor M2 can be coupled to the first terminal of the first transistor M1. The second bias current source CS2 is coupled to the second terminal of the second transistor M2 and can generate the second bias current $I_{B2}$.

Since the control terminal of the second transistor M2 can receive the fixed second reference voltage $V_B$, the output voltage $V_{OUT}$ at the second terminal of the second transistor M2 can be maintained at a required level with the properly adjusted second bias current $I_{B2}$. In some embodiments, the first transistor M1 and the second transistor M2 can be transistors of the same type with the same size so that the output voltage $V_{OUT}$ would be substantially equal to the first reference voltage $V_A$. Furthermore, the second voltage V2 can be greater than the first voltage V1. For example, the second voltage V2 can be the supply voltage received by the voltage regulation device 200, and the first voltage V1 can be the reference ground voltage of the voltage regulation device 200.

When the voltage regulation device 200 provides the output voltage $V_{OUT}$ to the load circuit LD, if the load current $I_{LD}$ consumed by the load circuit LD is rather big, then the output voltage $V_{OUT}$ may be dropped. To prevent the output voltage $V_{OUT}$ from dropping drastically or dropping for a long time, making the load circuit LD function abnormally, the detection adjustment circuit 210 can increase the voltage at the control terminal of the second transistor M2 to reduce the dropping level of the output voltage $V_{OUT}$ or even bring the output voltage $V_{OUT}$ back to the predetermined stable level when the detection adjustment circuit 210 detects the dropping of the output voltage $V_{OUT}$.

The detection adjustment circuit 210 includes a compensation current source 212, a third transistor M3, a fourth transistor M4, and a third bias current source CS3.

The third transistor M3 has a first terminal, a second terminal, and a control terminal. The first terminal of the third transistor M3 is coupled to the compensation current source 212, and the control terminal of the third transistor M3 is coupled to the second terminal of the first transistor M1. The fourth transistor M4 has a first terminal, a second terminal, and a control terminal. The first terminal of the fourth transistor M4 can receive the second voltage V2, the second terminal of the fourth transistor M4 is coupled to the second terminal of the third transistor M3, and the control terminal of the fourth transistor M4 is coupled to the second terminal of the second transistor M2. The third bias current source CS3 is coupled to the second terminal of the third transistor M3 and the second terminal of the fourth transistor M4. The third bias current source CS3 can generate the third bias current $I_{B3}$.

The compensation current source 212 is coupled to the control terminal of the second transistor M2. The compensation current source 212 includes a thirteenth transistor M13 and a fourteenth transistor M14. The thirteenth transistor M13 has a first terminal, a second terminal, and a control terminal. The first terminal of the thirteenth transistor M13 can receive the second voltage V2, the second terminal of the thirteenth transistor M13 is coupled to the first terminal of the third transistor M3, and the control terminal of the thirteenth transistor M13 is coupled to the second terminal of the thirteenth transistor M13. The fourteenth transistor M14 has a first terminal, a second terminal, and a control terminal. The first terminal of the fourteenth transistor M14 can receive the second voltage V2, the second terminal of the fourteenth transistor M14 is coupled to the control terminal of the second transistor M2, and the control terminal of the fourteenth transistor M14 is coupled to the control terminal of the thirteenth transistor M13.

The third transistor M3 and the fourth transistor M4 can form a differential pair. When the output voltage $V_{OUT}$ is smaller than the first reference voltage $V_A$, the fourth transistor M4 would be turned off, and the third bias current $I_{B3}$ generated by the third bias current source CS3 would be mainly drawn from the third transistor M3. Or, when the output voltage $V_{OUT}$ is greater than the first reference voltage $V_A$, the third transistor M3 would be turned off, and the third bias current $I_{B3}$ generated by the third bias current source CS3 would be mainly drawn from the fourth transistor M4.

Figure 4:
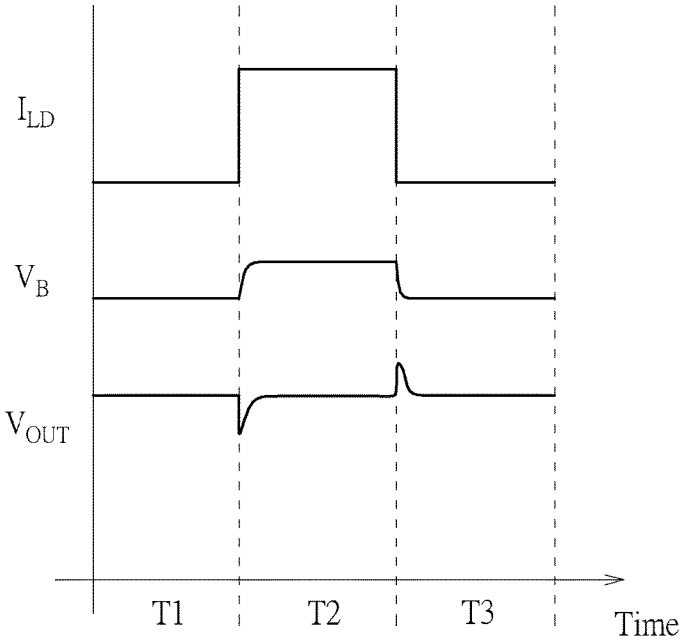
FIG. 4 shows the waveforms of current and voltage of the voltage regulation device in FIG. 3.
Figure 5:
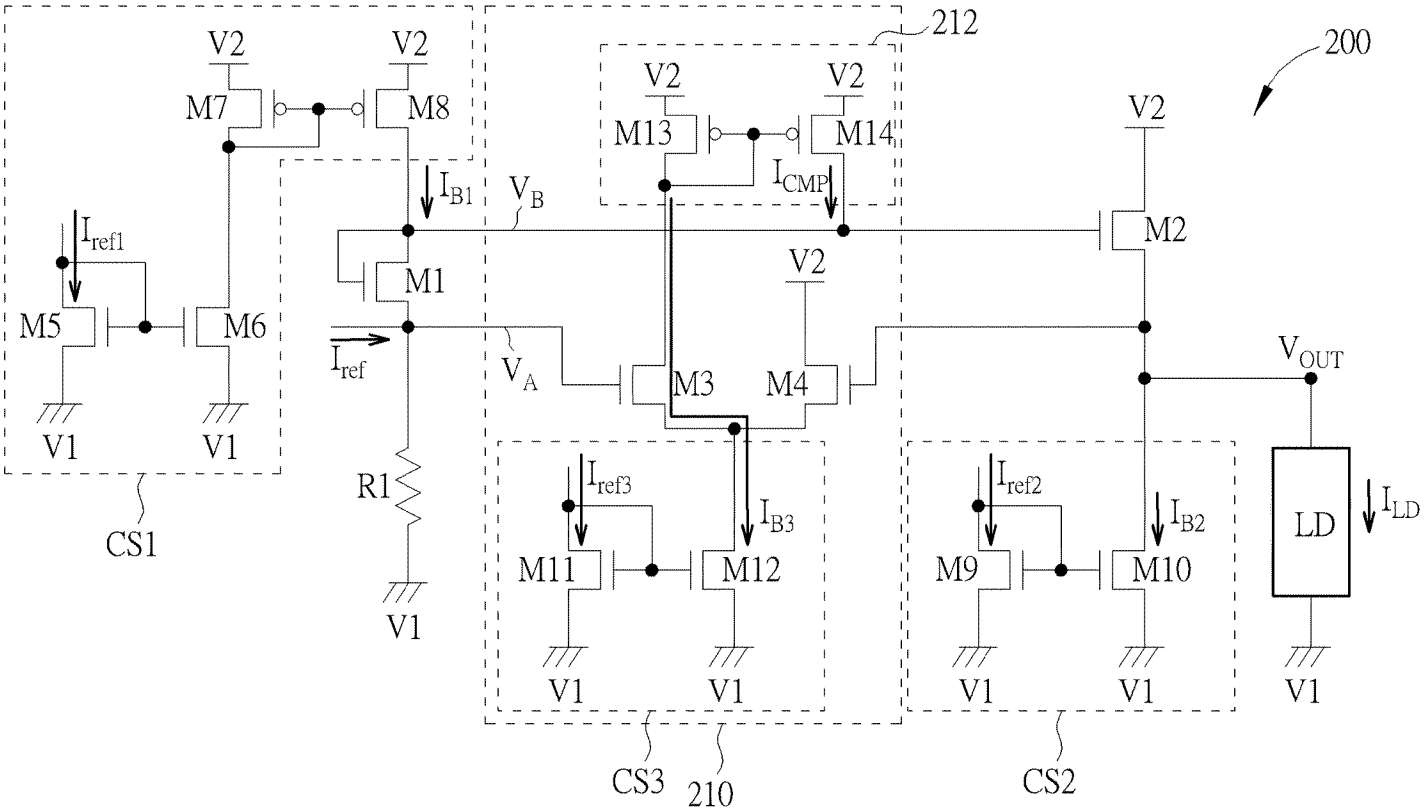
FIG. 5 shows the current flow in the voltage regulation device in FIG. 3.

FIG. 4 shows the waveforms of current and voltage of the voltage regulation device 200 according to one embodiment of the present invention. In FIG. 4, during the time period T1, the load current $I_{LD}$ consumed by the load circuit LD is 0, so the output voltage $V_{OUT}$ can remain at a fixed value predetermined by the system. However, during the time period T2, the load current $I_{LD}$ consumed by the load circuit LD increases so the output voltage $V_{OUT}$ is dropped to be lower than the first reference voltage $V_A$. FIG. 5 shows the current flow in the voltage regulation device 200 during the time period T2.

In FIG. 5, the fourth transistor M4 can be turned off and the third transistor M3 can be turned on. Therefore, the third bias current $I_{B3}$ generated by the third bias current source CS3 would be mainly drawn from the third transistor M3 and the thirteenth transistor M13. With the current mirror structure of the compensation current source 212, the fourteenth transistor M14 will also generate the compensation current $I_{CMP}$ corresponding to the third bias current $I_{B3}$. Consequently, the compensation current $I_{CMP}$ will flow into the control terminal of the second transistor M2, charging the parasitic gate capacitor of the second transistor M2, and increasing the voltage at the control terminal of the second transistor M2. That is, the second reference voltage $V_B$ can be raised.

Since the intensity of the current flowing through the second transistor M2 is positive related to the gate-to-source voltage of the second transistor M2, in the case that the current remains unchanged, when the voltage at the control terminal of the second transistor M2 is raised, the voltage at the second terminal of the second transistor M2, namely, the output voltage $V_{OUT}$ of the voltage regulation device 200, will also be raised. After the output voltage $V_{OUT}$ is raised, the fourth transistor M4 may also be turned on. In this case, the third bias current $I_{BS3}$ generated by the third current source CS3 would be drawn from both the third transistor M3 and the fourth transistor M4, reducing the compensation current $I_{CMP}$ and stabilizing the output voltage $V_{OUT}$.

Consequently, the voltage regulation device 200 can pull the output voltage $V_{OUT}$ back to the desired level predetermined by the system instantly when the load current $I_{LD}$ consumed by the load circuit LD increases drastically and the output voltage $V_{OUT}$ drops. Therefore, even when the load circuit LD consumes large load current $I_{LD}$, the load circuit LD can still function normally.

In FIG. 4, during the time period T3, the load current $I_{LD}$ consumed by the load circuit LD becomes 0 again. Therefore, the output voltage $V_{OUT}$ may increase instantaneously, making the output voltage $V_{OUT}$ greater than the first reference voltage $V_A$.

In this case, the fourth transistor M4 can be turned on and the third transistor M3 can be turned off. Therefore, the third bias current $I_{B3}$ generated by the third bias current source CS3 would be mainly drawn from the fourth transistor M4, and the compensation current source 212 would stop outputting the compensation current $I_{CMP}$ to the control terminal of the second transistor M2. Consequently, the voltage at the control terminal of the second transistor M2, that is, the second reference voltage $V_B$, would be dropped gradually and return to the predetermined value, and the output voltage $V_{OUT}$ would return to the desired value predetermined by the system.

Although during the time period T3, the output voltage $V_{OUT}$ may increase for a short period, the influences to the load circuit LD caused by the raised output voltage $V_{OUT}$ should be negligible since the load circuit LD does not consume any load current $I_{LD}$ during the time period T3.

In some embodiments, to avoid the unwanted power consumption caused by the large current, the third bias current $I_{B3}$ can be set to be smaller than the regulation current $I_{ref}$. For example, the third bias current $I_{B3}$ can be set to be smaller than ten percent of the regulation current $I_{ref}$. In addition, the channel width-to-length ratio of the fourth transistor M4 can be designed to be greater than the channel width-to-length ratio of the third transistor M3, preventing the compensation current source 212 from outputting large compensation current $I_{CMP}$ to the control terminal of the second transistor unnecessarily when the voltage regulation device 200 outputs the output voltage $V_{OUT}$ stably.

In the embodiment in FIG. 3, the first bias current source CS1 can include a fifth transistor M5, a sixth transistor M6, a seventh transistor M7, and an eighth transistor M8. The fifth transistor M5 has a first terminal, a second terminal, and a control terminal. The first terminal of the fifth transistor M5 can receive the first reference current $I_{ref1}$, the second terminal of the fifth transistor M5 can receive the first voltage V1, and the control terminal of the fifth transistor M5 is coupled to the first terminal of the fifth transistor M5. The sixth transistor M6 has a first terminal, a second terminal, and a control terminal. The second terminal of the sixth transistor M6 can receive the first voltage V1, and the control terminal of the sixth transistor M6 is coupled to the control terminal of the fifth transistor M5. The seventh transistor M7 has a first terminal, a second terminal, and a control terminal. The first terminal of the seventh transistor M7 can receive the second voltage V2, and the second terminal of the seventh transistor M7 and the control terminal of the seventh transistor M7 are coupled to the first terminal of the sixth transistor M6. The eighth transistor M8 has a first terminal, a second terminal, and a control terminal. The first terminal of the eighth transistor M8 can receive the second voltage V2, and the second terminal of the eighth transistor M8 is coupled to the first terminal of the first transistor M1 and can output the first bias current $I_{B1}$. Also, the control terminal of the eighth transistor M8 is coupled to the control terminal of the seventh transistor M7.

In other words, the fifth transistor M5 and the sixth transistor M6 can form a current mirror structure. Therefore, the first reference current $I_{ref1}$ received by the fifth transistor M5 would be copied to the sixth transistor M6. Also, the seventh transistor M7 and the eighth transistor M8 can form a current mirror structure. Therefore, the first bias current $I_{B1}$ can be generated according to the first reference current $I_{ref1}$. In some embodiments of the present invention, the channel width-to-length ratio of the fifth transistor M5 and the channel width-to-length ratio of the sixth transistor M6 can be the same, and the channel width-to-length ratio of the seventh transistor M7 and the channel width-to-length ratio of the eighth transistor M8 can be the same. However, in other embodiments, the user may also select the fifth transistor M5 and the sixth transistor M6 to have different channel width-to-length ratios, or select the seventh transistor M7 and the eighth transistor M8 to have different channel width-to-length ratios for generating the desired bias currents according to the real requirements.

The second bias current source CS2 includes a ninth transistor M9 and a tenth transistor M10. The ninth transistor M9 has a first terminal, a second terminal, and a control terminal. The first terminal of the ninth transistor M9 can receive the second reference current $I_{ref2}$, the second terminal of the ninth transistor M9 can receive the first voltage V1, and the control terminal of the ninth transistor M9 can be coupled to the first terminal of the ninth transistor M9. The tenth transistor M10 has a first terminal, a second terminal, and a control terminal. The first terminal of the tenth transistor M10 is coupled to the second terminal of the second transistor M2, the second terminal of the tenth transistor M10 can receive the first voltage V1, and the control terminal of the tenth transistor M10 is coupled to the control terminal of the ninth transistor M9.

That is, the ninth transistor M9 and the tenth transistor M10 can form the structure of current mirror so the second bias current 1B2 can be generated according to the second reference current $I_{ref2}$ received by the ninth transistor M9. In some embodiments, the channel width-to-length ratio of the ninth transistor M9 and the channel width-to-length ratio of the tenth transistor M10 can be the same. However, in some other embodiments, the user may also select the ninth transistor M9 and the tenth transistor M10 to have different channel width-to-length ratios according to the requirement.

The third bias current source CS3 can include an eleventh transistor M11 and a twelfth transistor M12. The eleventh transistor M11 has a first terminal, a second terminal, and a control terminal. The first terminal of the eleventh transistor M11 can receive the third reference current $I_{ref3}$, the second terminal of the eleventh transistor M11 can receive the first voltage V1, and the control terminal of the eleventh transistor M11 can be coupled to the first terminal of the eleventh transistor M11. The twelfth transistor M12 has a first terminal, a second terminal, and a control terminal. The first terminal of the twelfth transistor M12 is coupled to the second terminal of the fourth transistor M4, the second terminal of the twelfth transistor M12 can receive the first voltage V1, and the control terminal of the twelfth transistor M12 is coupled to the control terminal of the eleventh transistor M11.

In other words, the eleventh transistor M11 and the twelfth transistor M12 can form the structure of current mirror so the third bias current $I_{B3}$ can be generated according to the third reference current $I_{ref3}$ received by the eleventh transistor M11. In some embodiments, the channel width-to-length ratio of the eleventh transistor M11 and the channel width-to-length ratio of the twelfth transistor M12 can be the same. However, in some other embodiments, the user may also select the eleventh transistor M11 and the twelfth transistor M12 to have different channel width-to-length ratios according to the requirement.

Furthermore, in the embodiment shown in FIG. 3, the first transistor M1, the second transistor M2, the third transistor M3, the fourth transistor M4, the fifth transistor M5, the sixth transistor M6, the ninth transistor M9, the tenth transistor M10, the eleventh transistor M11, and the twelfth transistor M12 can be N type transistors. However, the seventh transistor M7, the eighth transistor M8, the thirteenth transistor M13, and the fourteenth transistor M14 can be P type transistors. However, in some other embodiments, the user may also choose different types of transistors to implement the voltage regulation device according to the system requirement.

In summary, the voltage regulation device provided by the embodiments of the present invention can adjust the output voltage to return to the predetermined voltage level instantly with the detection adjustment circuit when the load circuit consumes large current and causes the output voltage to drop. Therefore, the load circuit can be protected from functioning abnormally due to the dropping of the output voltage, and the system stability can be improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A voltage regulation device comprising:

a first bias current source configured to generate a first bias current;

a first transistor having a first terminal configured to receive the first bias current, a second terminal, and a control terminal coupled to the first terminal of the first transistor;

a bias resistor having a first terminal coupled to the second terminal of the first transistor and configured to receive a regulation current, and a second terminal configured to receive a first voltage;

a second transistor having a first terminal configured to receive a second voltage, a second terminal configured to output an output voltage, and a control terminal coupled to the first terminal of the first transistor;

a second bias current source coupled to the second terminal of the second transistor and configured to generate a second bias current; and a detection adjustment circuit comprising:

a compensation current source coupled to the control terminal of the second transistor;

a third transistor having a first terminal coupled to the compensation current source, a second terminal, and a control terminal coupled to the second terminal of the first transistor;

a fourth transistor having a first terminal configured to receive the second voltage, a second terminal coupled to the second terminal of the third transistor, and a control terminal coupled to the second terminal of the second transistor; and a third bias current source coupled to the second terminal of the fourth transistor and configured to generate a third bias current.

2. The voltage regulation device of claim 1, wherein a channel width-to-length ratio of the fourth transistor is greater than a channel width-to-length ratio of the third transistor.

3. The voltage regulation device of claim 1, wherein the first transistor, the second transistor, the third transistor, and the fourth transistor are N type transistors.

4. The voltage regulation device of claim 1, wherein the regulation current is greater than the first bias current.

5. The voltage regulation device of claim 1, wherein the third bias current is smaller than the regulation current.

6. The voltage regulation device of claim 1, wherein the first bias current source comprises:

a fifth transistor having a first terminal configured to receive a first reference current, a second terminal configured to receive the first voltage, and a control terminal coupled to the first terminal of the fifth transistor;

a sixth transistor having a first terminal, a second terminal configured to receive the first voltage, and a control terminal coupled to the control terminal of the fifth transistor;

a seventh transistor having a first terminal configured to receive the second voltage, a second terminal coupled to the first terminal of the sixth transistor, and a control terminal coupled to the first terminal of the sixth transistor; and an eighth transistor having a first terminal configured to receive the second voltage, a second terminal coupled to the first terminal of the first transistor and configured to output the first bias current, and a control terminal coupled to the control terminal of the seventh transistor;

wherein the fifth transistor and the sixth transistor are N type transistors, and the seventh transistor and the eighth transistor are P type transistors.

7. The voltage regulation device of claim 1, wherein the second bias current source comprises:

a ninth transistor having a first terminal configured to receive a second reference current, a second terminal configured to receive the first voltage, and a control terminal coupled to the first terminal of the ninth transistor; and a tenth transistor having a first terminal coupled to the second terminal of the second transistor, a second terminal configured to receive the first voltage, and a control terminal coupled to the control terminal of the ninth transistor;

wherein the ninth transistor and the tenth transistor are N type transistors.

8. The voltage regulation device of claim 1, wherein the third bias current source comprises:

an eleventh transistor having a first terminal configured to receive a third reference current, a second terminal configured to receive the first voltage, and a control terminal coupled to the first terminal of the eleventh transistor; and a twelfth transistor having a first terminal coupled to the second terminal of the fourth transistor, a second terminal configured to receive the first voltage, and a control terminal coupled to the control terminal of the eleventh transistor;

wherein the eleventh transistor and the twelfth transistor are N type transistors.

9. The voltage regulation device of claim 1, wherein the compensation current source comprises:

a thirteenth transistor having a first terminal configured to receive the second voltage, a second terminal coupled to the first terminal of the third transistor, and a control terminal coupled to the second terminal of the thirteenth transistor; and a fourteenth transistor having a first terminal configured to receive the second voltage, a second terminal coupled to the control terminal of the second transistor, and a control terminal coupled to the control terminal of the thirteenth transistor;

wherein the thirteenth transistor and the fourteenth transistor are P type transistors.

10. The voltage regulation device of claim 1, wherein:

the output voltage is provided to a load circuit; and when the load circuit consumes a loading current so as to lower a voltage at the second terminal of the second transistor:

the fourth transistor is turned off; and the third transistor is turned on so as to enable the compensation current source to output a compensation current to the control terminal of the second transistor.

* * * * *